United States Patent [19]

Birch

[11] 4,367,870

[45] Jan. 11, 1983

[54] SHOULDER STAND DEVICE

[76] Inventor: Robert A. Birch, Gardner Hollow Rd., Poughquag, N.Y. 12570

[21] Appl. No.: 143,553

[22] Filed: Apr. 25, 1980

[51] Int. Cl.[3] ..... A63B 23/02; A47C 3/02

[52] U.S. Cl. ..... 272/144; 128/70; 297/258; 297/270

[58] Field of Search ..... 272/33 R, 33 A, 93, 272/111, 115, 134, 144, 56; 297/258, 270–272, 458, DIG. 7, 1–3, 93, 94, 193, 230, 231, 283, 284, 310, 397, 438, 460, DIG. 2, DIG. 3; 128/25 R, 70–75

[56] References Cited

U.S. PATENT DOCUMENTS

| | | | |
|---|---|---|---|
| D. 194,973 | 4/1963 | Mueller | D6/10 |
| 885,243 | 4/1908 | Haas | 272/144 X |
| 1,904,039 | 4/1933 | Bruder | 272/144 X |
| 1,911,572 | 5/1933 | Hulander et al. | 272/56 X |
| 1,914,473 | 6/1933 | Wilson | 297/270 X |
| 2,482,306 | 9/1949 | Waldheim | 297/270 |
| 2,533,273 | 12/1950 | MacGregor | 272/144 |
| 3,117,782 | 1/1964 | Johnston | 272/144 X |
| 3,451,672 | 6/1969 | Kazdan | 272/56 X |
| 3,526,429 | 9/1970 | Metzger | 297/258 |
| 3,713,696 | 1/1973 | Dudley | 297/458 X |
| 3,866,605 | 2/1975 | Stakeman | 128/70 |
| 4,033,622 | 7/1977 | Boudreau | 297/310 X |
| 4,099,773 | 7/1978 | Chang | 272/56 X |
| 4,109,960 | 8/1978 | Stinchfield | 297/258 |
| 4,133,524 | 1/1979 | Barlew | 272/111 |
| 4,183,580 | 1/1980 | Johansson | D6/9 X |

FOREIGN PATENT DOCUMENTS

| | | | |
|---|---|---|---|
| 552292 | 3/1943 | United Kingdom | 297/284 |

*Primary Examiner*—Richard C. Pinkham
*Assistant Examiner*—Arnold W. Kramer
*Attorney, Agent, or Firm*—John B. Dickman, III

[57] ABSTRACT

A health and exercise device comprising a rockable structure with vertical and horizontal body supporting portions connected by an arcuate portion, the user sitting on the horizontal portion and rocking backward into a shoulder stand position when exercising.

1 Claim, 7 Drawing Figures

SHOULDER STAND DEVICE

BACKGROUND OF THE INVENTION

This invention relates generally to a simple inexpensive device which will enable a person who is unskilled and untrained in Yoga, Sarvangasana, and the culture and positions associated therewith, to assume the desired positions, especially the shoulder stand, and attain the health and well-being and other benefits associated therewith.

For centuries, the practitioners of Yoga and similar arts have assumed the head and shoulder stand positions with the legs vertical, and have attained the multiple benefits associated therewith. These benefits were not available to the average individual, however, without extensive exercising and training, and while many persons wanted the benefits associated with said shoulder stands and other positions, very few were willing to undergo the rigid disipline and training necessary to achieve these benefits. With the present invention, however, any person can easily assume the shoulder stand, with no training and in perfect safety.

Prior art devices for rotating or rocking the body in forward and backward positions for exercise and amusement are shown in U.S. Pat. Nos. 3,102,280 and 3,235,253. Neither of these can be used to perform the shoulder stand, which is the primary exercise involved herewith. Both of these prior art devices substantially differ from applicants structure in function and appearance

SUMMARY OF THE INVENTION

It is therefore an object of this invention to provide a device for enabling an unskilled person to perform the Sarvangasana exercises, particularly the shoulder stand, with no prior skill and training.

A further object is to provide a device of this type which is simple and inexpensive to manufacture.

A still further object is to provide such a device which can be easily cleaned and kept in a sanitary condition.

A still further object is to provide such a device which can be made in a rigid or knockdown form.

A still further object is to provide such a device which can be made of wood, fiberglass, plastic and the like, and can be made of planar or curved members, pipe, angle iron and similar support structures.

A still further object is to adapt an existing chair into the present type of device.

Other and further objects will appear in the specification and drawings.

BRIEF DESCRIPTION OF THE DRAWINGS

The preferred form of the basic structure is represented by the numeral 10, said structure comprising an arcuate main body portion 12, having oppositely extended planar portions 13 and 14, with side walls 15 and 16. The side walls 16 have cut out portions 18 formed therein to allow the shoulders of the user to fit comfortably, as shown in FIG. 1. A removable cushioning pad 20, which may be foam plastic, fiber, inflatable or the like, is shaped to fit the back of a users head, and to cushion the users body in other areas, also shown in FIG. 1. A wedge shaped member 22, comprising a bottom portion 24 and triangular side portions 26 and 28, is used to assist the person to fully elevate the legs in a vertical position. If desired, a head rest may be formed directly on the main body portion with no cushion being used. As shown in FIG. 5, shoulder supports a, b and c, or any other suitable shaped supports, may be placed under the pad 20. These shoulder supports may be made of any suitable material. If the device is made of fiberglass, the head rest can be molded in the fiberglass during manufacture, if made of wood, the wood can be steam formed or cut away to form the rest for the head. The side walls may be integral with said base, or may be made removable for ease in shipping, storing, assembly and disassembly. The numeral 23 denotes a modification of the shape of the device which will allow ease of stacking and results in a different type of support for the body.

Figure 6:
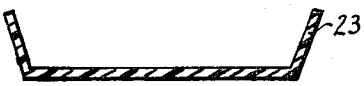
FIG. 6 shows the device formed with flared sides for ease in stacking and different type of body support.
Figure 4:
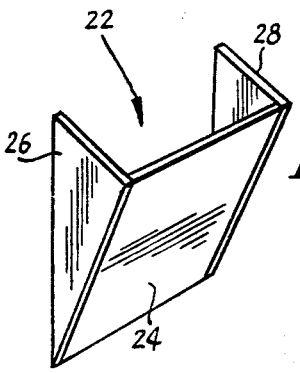
FIG. 4 is a perspective view of a wedge type structure which assists in elevating the legs of a user to a full vertical position.
Figure 3:
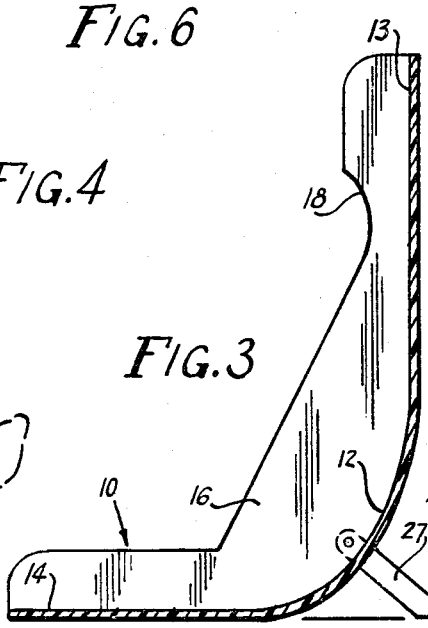
FIG. 3 is a sectional side elevation of the device, taken on the line 3—3 of FIG. 2, and showing a pivotally mounted support leg thereon.
Figure 2:
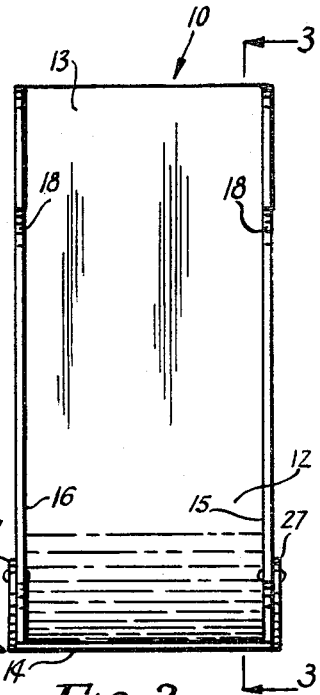
FIG. 2 is a front elevation of the device without the cushioning or supporting means thereon.
Figure 5:
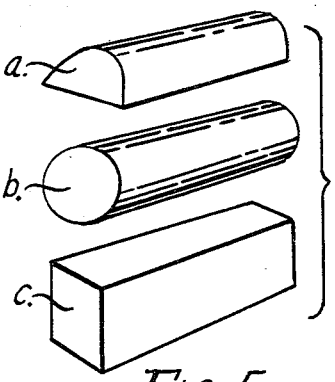
FIG. 5, *a*, *b* and *c*, shows various shapes of shoulder supports, both stationary and removable.
Figure 1:
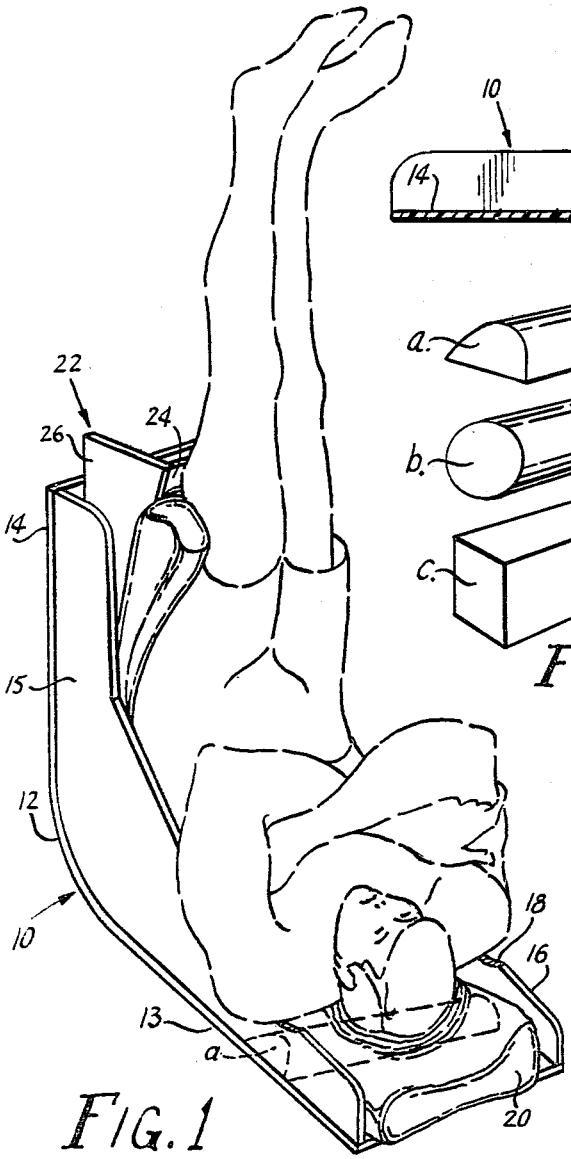
FIG. 1 is a perspective view of the preferred form of the invention in use.
Figure 7:
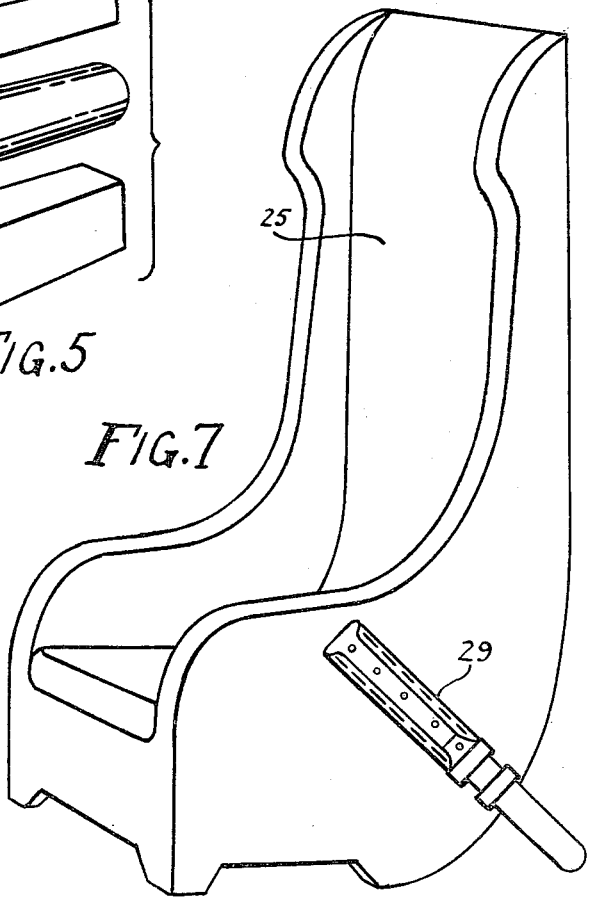
FIG. 7 shows the support leg attached to an average commercially produced chair.

The device is used in the following manner; The person desiring to perform the shoulder stand places the cushion 20 in the proper position in the device when it is in the position shown in FIG. 3. The wedge member 22 is placed under the cushion, also when the device is in the position shown in FIG. 3, then the user sits down on the cushion adjacent the wedge member, raises his arms and leans backwards, the device will easily roll backwards 90° so that the users head, neck and upper part of his shoulders will be parallel to the floor or other supporting surface, the rest of the body naturally and comfortably assuming the angle of a perfect shoulder stand, the legs being in a vertical position relative to the floor or other supporting surface. The users arms can then be folded and the position held as long as desired, then when the user decides to return to a sitting position, he extends his arms forward and the device will rotate forward 90°, thereby returning him to the sitting position. The user can cause his or her body to assume even a greater angle than the normal shoulder stand angle by merely placing the buttocks forward to the edge of the device when first sitting down, and conversely, a lesser angle than the normal shoulder stand angle may be assumed by placing the buttocks further back on the device when first sitting down. A pivotally mounted support leg 27 can be affixed to the device as shown in FIG. 3 and adapted to be rotated into a support position, thus making a chair or seating structure out of the device when it is not being used for the shoulder stand. Also, as shown in FIG. 7, a commercially available type of chair 25 can be adapted to be used with an adjustable retractable leg member 29, and can be used in a manner similar to that shown in FIG. 3.

The body portion could also be made of metal or plastic tubing, with the same materials forming the side walls or rails, the whole covered by canvas, plastic sheeting, cushioned pads or the like.

From the foregoing description it is readily apparent that the present device has numerous advantages, some of which have been described above and others of which are inherent in the invention. Also, it is obvious that modifications and variations can be made without departing from the spirit and scope of the invention.

I claim:

1. A device for assisting a person to assume a shoulder stand comprising a base member, said base member consisting of a horizontal planar seat portion and a vertical planar back portion positioned at substantially a 90° angle to each other, an arcuate portion connecting said horizontal and said vertical portions, said horizontal planar portion being shorter than said vertical portion and acting as a seat in the horizontal position and as a leg support in the vertical position, an upstanding side member on each side of said base member, each side member being the approximate length of said base member said side members having cut out portions therein to receive the shoulders of a user, a cushioning pad of the approximate length of said base member fitted between said side members and resting on said base member, at least one shaped member for insertion between said cushioning pad and said base member, at least one of said at least one shaped member being wedge shaped, said device being a seat when resting on its seat portion, and rotatable backwards 90° onto its back portion so that a person seated therein can assume a shoulder stand with the wedge shaped member being located between the backs of the thighs and the base member so that while lying on one's back the extended legs assume a position backward slightly beyond vertical so as to maintain the shoulder stand position, and pivotally mounted support legs on said upstanding side members rotatable from a non-use position when said device is used on its back for a shoulder stand to a use position when used as a seat by extending back beyond the base so as to prevent rearward tilting.

* * * * *